US007164387B2

(12) United States Patent
Sievenpiper

(10) Patent No.: US 7,164,387 B2
(45) Date of Patent: Jan. 16, 2007

(54) COMPACT TUNABLE ANTENNA

(75) Inventor: Daniel F. Sievenpiper, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 10/836,966

(22) Filed: Apr. 30, 2004

(65) Prior Publication Data

US 2004/0227678 A1 Nov. 18, 2004

Related U.S. Application Data

(60) Provisional application No. 60/470,025, filed on May 12, 2003.

(51) Int. Cl.
*H01Q 1/24* (2006.01)

(52) U.S. Cl. ..... 343/702; 343/700 MS; 343/876; 343/866

(58) Field of Classification Search ..... 343/702, 343/703, 700 MS; 333/103
See application file for complete search history.

(56) References Cited

U.S. PATENT DOCUMENTS

| | | | | |
|---|---|---|---|---|
| 3,267,480 | A | 8/1966 | Lerner | 343/911 |
| 3,560,978 | A | 2/1971 | Himmel et al. | 343/106 |
| 3,810,183 | A | 5/1974 | Krutsinger et al. | 343/708 |
| 3,961,333 | A | 6/1976 | Purinton | 343/872 |
| 4,045,800 | A | 8/1977 | Tang et al. | 343/854 |
| 4,051,477 | A | 9/1977 | Murphy et al. | 343/700 MS |
| 4,119,972 | A | 10/1978 | Fletcher et al. | 343/844 |
| 4,123,759 | A | 10/1978 | Hines et al. | 343/854 |
| 4,124,852 | A | 11/1978 | Steudel | 343/854 |
| 4,127,586 | A | 11/1978 | Rody et al. | 260/308 B |
| 4,150,382 | A | 4/1979 | King | 343/754 |
| 4,173,759 | A | 11/1979 | Bakhru | 343/100 |
| 4,189,733 | A | 2/1980 | Malm | 343/100 SA |
| 4,217,587 | A | 8/1980 | Jacomini | 343/100 SA |
| 4,220,954 | A | 9/1980 | Marchland | 343/113 R |
| 4,236,158 | A | 11/1980 | Daniel | 343/100 LE |
| 4,242,685 | A | 12/1980 | Sanford | 343/770 |

(Continued)

FOREIGN PATENT DOCUMENTS

DE 196 00 609 A1 4/1997

(Continued)

OTHER PUBLICATIONS

U.S. Appl. No. 10/944,032, filed Sep. 17, 2004, Sievenpiper.

(Continued)

*Primary Examiner*—Don Wong
*Assistant Examiner*—Binh Van Ho
(74) *Attorney, Agent, or Firm*—Ladas & Parry LLP

(57) ABSTRACT

The present disclosure relates to a method and an antenna for transmitting/receiving a RF signal at a plurality of different frequencies. Transmitting/receiving a RF signal at a plurality of different frequencies is achieved by providing a F antenna comprising a plurality of switches which can be used to adjust the resonant frequency of the antenna. By providing a F antenna, the antenna will be much smaller than the wavelength at which the antenna is operating. This allows the antenna to be used in compact devices such as PDA's and cellular phones.

45 Claims, 6 Drawing Sheets

U.S. PATENT DOCUMENTS

Figure 1A:
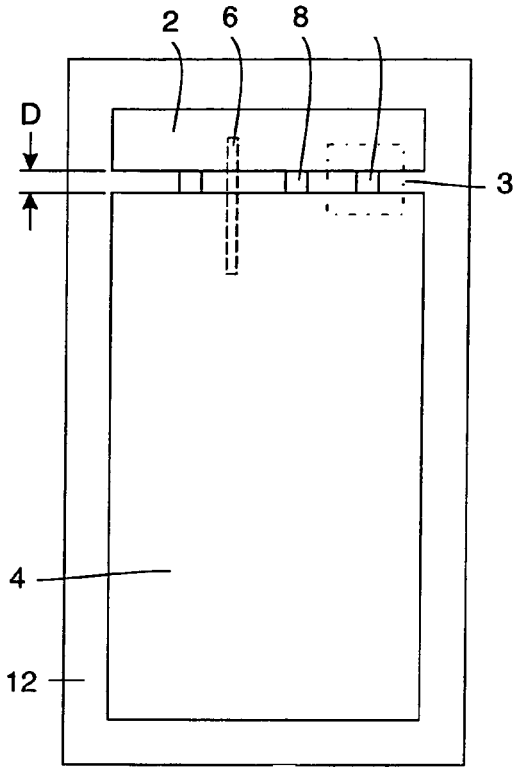

| | | | | |
|---|---|---|---|---|
| 4,266,203 | A | 5/1981 | Saudreau et al. | 333/21 A |
| 4,308,541 | A | 12/1981 | Seidel et al. | 343/786 |
| 4,367,475 | A | 1/1983 | Schiavone | 343/767 |
| 4,370,659 | A | 1/1983 | Chu et al. | 343/772 |
| 4,387,377 | A | 6/1983 | Kandler | 343/756 |
| 4,395,713 | A | 7/1983 | Nelson et al. | 343/713 |
| 4,443,802 | A | 4/1984 | Mayes | 343/729 |
| 4,590,478 | A | 5/1986 | Powers et al. | 343/700 MS |
| 4,594,595 | A | 6/1986 | Struckman | 343/770 |
| 4,672,386 | A | 6/1987 | Wood | 343/770 |
| 4,684,953 | A | 8/1987 | Hall | 343/725 |
| 4,700,197 | A | 10/1987 | Milne | 343/837 |
| 4,737,795 | A | 4/1988 | Nagy et al. | 343/712 |
| 4,749,996 | A | 6/1988 | Tresselt | 343/700 MS |
| 4,760,402 | A | 7/1988 | Mizuno et al. | 343/713 |
| 4,782,346 | A | 11/1988 | Sharma | 343/795 |
| 4,803,494 | A | 2/1989 | Norris et al. | 343/770 |
| 4,821,040 | A | 4/1989 | Johnson et al. | 343/700 MS |
| 4,835,541 | A | 5/1989 | Johnson et al. | 343/713 |
| 4,843,400 | A | 6/1989 | Tsao et al. | 343/700 MS |
| 4,843,403 | A | 6/1989 | Lalezari et al. | 343/767 |
| 4,853,704 | A | 8/1989 | Diaz et al. | 343/767 |
| 4,903,033 | A | 2/1990 | Tsao et al. | 343/700 MS |
| 4,905,014 | A | 2/1990 | Gonzalez et al. | 343/909 |
| 4,916,457 | A | 4/1990 | Foy et al. | 343/770 |
| 4,922,263 | A | 5/1990 | Dubost et al. | 343/797 |
| 4,958,165 | A | 9/1990 | Axford et al. | 343/770 |
| 4,975,712 | A | 12/1990 | Chen | 343/754 |
| 5,021,795 | A | 6/1991 | Masiulis | 343/700 MS |
| 5,023,623 | A | 6/1991 | Kreinheder et al. | 343/725 |
| 5,070,340 | A | 12/1991 | Diaz | 343/767 |
| 5,081,466 | A | 1/1992 | Bitter, Jr. | 343/767 |
| 5,115,217 | A | 5/1992 | McGrath et al. | 333/246 |
| 5,146,235 | A | 9/1992 | Frese | 343/895 |
| 5,158,611 | A | 10/1992 | Ura et al. | 106/499 |
| 5,218,374 | A | 6/1993 | Koert et al. | 343/789 |
| 5,235,343 | A | 8/1993 | Audren et al. | 343/816 |
| 5,268,696 | A | 12/1993 | Buck et al. | 342/372 |
| 5,268,701 | A | 12/1993 | Smith | 343/767 |
| 5,287,116 | A | 2/1994 | Iwasaki et al. | 343/700 MS |
| 5,287,118 | A | 2/1994 | Budd | 343/909 |
| 5,402,134 | A | 3/1995 | Miller et al. | 343/742 |
| 5,406,292 | A | 4/1995 | Schnetzer et al. | 343/700 MS |
| 5,519,408 | A | 5/1996 | Schnetzer | 343/767 |
| 5,525,954 | A | 6/1996 | Komazaki et al. | 333/219 |
| 5,531,018 | A | 7/1996 | Saia et al. | 29/622 |
| 5,532,709 | A | 7/1996 | Talty | 343/819 |
| 5,534,877 | A | 7/1996 | Sorbello et al. | 343/700 MS |
| 5,541,614 | A | 7/1996 | Lam et al. | 343/792.5 |
| 5,557,291 | A | 9/1996 | Chu et al. | 343/725 |
| 5,581,266 | A | 12/1996 | Peng et al. | 343/770 |
| 5,589,845 | A | 12/1996 | Yandrofski et al. | 343/909 |
| 5,598,172 | A | 1/1997 | Chekroun | 343/754 |
| 5,611,940 | A | 3/1997 | Zettler | 73/514.16 |
| 5,621,571 | A * | 4/1997 | Bantli et al. | 359/529 |
| 5,638,946 | A | 6/1997 | Zavracky | 200/181 |
| 5,644,319 | A | 7/1997 | Chen et al. | 343/702 |
| 5,694,134 | A | 12/1997 | Barnes | 343/700 |
| 5,721,194 | A | 2/1998 | Yandrofski et al. | 505/210 |
| 5,767,807 | A | 6/1998 | Pritchett | 342/374 |
| 5,808,527 | A | 9/1998 | De Los Santos | 333/205 |
| 5,874,915 | A | 2/1999 | Lee et al. | 342/375 |
| 5,892,485 | A | 4/1999 | Glabe et al. | 343/789 |
| 5,894,288 | A | 4/1999 | Lee et al. | 343/770 |
| 5,905,465 | A | 5/1999 | Olson et al. | 343/700 MS |
| 5,923,303 | A | 7/1999 | Schwengler et al. | 343/853 |
| 5,926,139 | A | 7/1999 | Korisch | 343/702 |
| 5,929,819 | A | 7/1999 | Grinberg | 343/754 |
| 5,943,016 | A | 8/1999 | Snyder, Jr. et al. | 343/700 MS |
| 5,945,951 | A | 8/1999 | Monte et al. | 343/700 MS |
| 5,949,382 | A | 9/1999 | Quan | 343/767 |
| 5,966,096 | A | 10/1999 | Brachat | 343/700 MS |
| 5,966,101 | A | 10/1999 | Haub et al. | 343/767 |
| 6,005,519 | A | 12/1999 | Burns | 343/700 MS |
| 6,005,521 | A | 12/1999 | Suguro et al. | 343/700 MS |
| 6,008,770 | A | 12/1999 | Sugawara | 343/767 |
| 6,016,125 | A | 1/2000 | Johansson | 343/702 |
| 6,028,561 | A | 2/2000 | Takei | 343/767 |
| 6,034,644 | A | 3/2000 | Okabe et al. | 343/767 |
| 6,034,655 | A | 3/2000 | You | 345/60 |
| 6,037,905 | A | 3/2000 | Koscica et al. | 343/701 |
| 6,040,803 | A | 3/2000 | Spall | 343/700 MS |
| 6,046,655 | A | 4/2000 | Cipolla | 333/137 |
| 6,046,659 | A | 4/2000 | Loo et al. | 333/362 |
| 6,054,659 | A | 4/2000 | Lee et al. | 200/181 |
| 6,061,025 | A | 5/2000 | Jackson et al. | 343/700 MS |
| 6,075,485 | A | 6/2000 | Lilly et al. | 343/700 MS |
| 6,081,235 | A | 6/2000 | Romanofsky et al. | 343/700 MS |
| 6,081,239 | A | 6/2000 | Sabet et al. | 343/753 |
| 6,097,263 | A | 8/2000 | Mueller et al. | 333/17.1 |
| 6,097,343 | A | 8/2000 | Goetz et al. | 343/708 |
| 6,118,406 | A | 9/2000 | Josypenko | 343/700 MS |
| 6,118,410 | A | 9/2000 | Nagy | 343/713 |
| 6,127,908 | A | 10/2000 | Bozler et al. | 333/246 |
| 6,150,989 | A | 11/2000 | Aubry | 343/767 |
| 6,154,176 | A | 11/2000 | Fathy et al. | 343/700 MS |
| 6,166,705 | A | 12/2000 | Mast et al. | 343/853 |
| 6,175,337 | B1 | 1/2001 | Jasper, Jr. et al. | 343/770 |
| 6,175,723 | B1 | 1/2001 | Rothwell, III | 455/63 |
| 6,188,369 | B1 | 2/2001 | Okabe et al. | 343/767 |
| 6,191,724 | B1 | 2/2001 | McEwan | 342/21 |
| 6,198,438 | B1 | 3/2001 | Herd et al. | 343/700 MS |
| 6,198,441 | B1 | 3/2001 | Okabe et al. | 343/702 |
| 6,204,819 | B1 * | 3/2001 | Hayes et al. | 343/702 |
| 6,218,912 | B1 | 4/2001 | Mayer | 333/106 |
| 6,218,997 | B1 | 4/2001 | Lindenmeier et al. | 343/725 |
| 6,246,377 | B1 | 6/2001 | Aiello et al. | 343/700 |
| 6,252,473 | B1 | 6/2001 | Ando | 333/105 |
| 6,285,325 | B1 | 9/2001 | Nalbandian et al. | 343/700 MS |
| 6,307,519 | B1 | 10/2001 | Livingston et al. | 343/767 |
| 6,317,095 | B1 | 11/2001 | Teshirogi et al. | 343/785 |
| 6,323,826 | B1 | 11/2001 | Sievenpiper et al. | 343/909 |
| 6,331,257 | B1 | 12/2001 | Loo et al. | 216/13 |
| 6,337,668 | B1 | 1/2002 | Ito et al. | 343/833 |
| 6,366,254 | B1 | 4/2002 | Sievenpiper et al. | 343/700 |
| 6,373,349 | B1 | 4/2002 | Gilbert | 333/126 |
| 6,380,895 | B1 | 4/2002 | Moren et al. | 343/700 MS |
| 6,388,631 | B1 | 5/2002 | Livingston et al. | 343/767 |
| 6,392,610 | B1 | 5/2002 | Braun et al. | 343/876 |
| 6,404,390 | B1 | 6/2002 | Sheen | 343/700 MS |
| 6,404,401 | B1 | 6/2002 | Gilbert et al. | 343/780 |
| 6,407,719 | B1 | 6/2002 | Ohira et al. | 343/893 |
| 6,417,807 | B1 | 7/2002 | Hsu et al. | 343/700 MS |
| 6,424,319 | B1 | 7/2002 | Ebling et al. | 343/911 L |
| 6,426,722 | B1 | 7/2002 | Sievenpiper et al. | 343/700 MS |
| 6,440,767 | B1 | 8/2002 | Loo et al. | 438/52 |
| 6,469,673 | B1 * | 10/2002 | Kaiponen | 343/703 |
| 6,473,362 | B1 | 10/2002 | Gabbay | 367/119 |
| 6,483,480 | B1 | 11/2002 | Sievenpiper et al. | 343/909 |
| 6,496,155 | B1 | 12/2002 | Sievenpiper et al. | 343/770 |
| 6,515,635 | B1 | 2/2003 | Chiang et al. | 343/834 |
| 6,518,931 | B1 | 2/2003 | Sievenpiper | 343/700 |
| 6,525,695 | B1 | 2/2003 | McKinzie, III | 343/756 |
| 6,538,621 | B1 | 3/2003 | Sievenpiper et al. | 343/909 |
| 6,552,696 | B1 | 4/2003 | Sievenpiper et al. | 343/909 |
| 6,624,720 | B1 | 9/2003 | Allison et al. | 333/105 |
| 6,642,889 | B1 | 11/2003 | McGrath | 343/700 MS |
| 6,657,525 | B1 | 12/2003 | Dickens et al. | 335/78 |
| 6,741,207 | B1 | 5/2004 | Allison et al. | 342/371 |
| 6,822,622 | B1 | 11/2004 | Crawford et al. | 343/909 |
| 6,897,810 | B1 * | 5/2005 | Dai et al. | 343/700 MS |
| 2001/0035801 | A1 | 11/2001 | Gilbert | 333/126 |
| 2002/0036586 | A1 | 3/2002 | Gothard et al. | 342/374 |

| | | | | |
|---|---|---|---|---|
| 2003/0122721 | A1 | 7/2003 | Sievenpiper | 343/767 |
| 2003/0193446 | A1 | 10/2003 | Chen | 343/893 |
| 2003/0222738 | A1* | 12/2003 | Brown et al. | 333/206 |
| 2003/0227351 | A1 | 12/2003 | Sievenpiper | 333/105 |
| 2004/0113713 | A1* | 6/2004 | Zipper et al. | 333/103 |
| 2004/0135649 | A1 | 7/2004 | Sievenpiper | 333/105 |
| 2004/0227583 | A1 | 11/2004 | Shaffner et al. | 333/32 |
| 2004/0227667 | A1 | 11/2004 | Sievenpiper | 343/700 |
| 2004/0227668 | A1 | 11/2004 | Sievenpiper | 343/700 |
| 2004/0263408 | A1 | 12/2004 | Sievenpiper et al. | 343/757 |
| 2005/0012667 | A1 | 1/2005 | Noujeim | 343/700 MS |

FOREIGN PATENT DOCUMENTS

| | | | |
|---|---|---|---|
| EP | 0 539 297 | | 4/1993 |
| EP | 1 158 605 | A1 | 11/2001 |
| FR | 2 785 476 | | 5/2000 |
| GB | 1145208 | | 3/1969 |
| GB | 2 281 662 | | 3/1995 |
| GB | 2 328 748 | | 3/1999 |
| JP | 61-260702 | | 11/1986 |
| WO | 94/00891 | | 1/1994 |
| WO | 96/29621 | | 9/1996 |
| WO | 98/21734 | | 5/1998 |
| WO | 99/50929 | | 10/1999 |
| WO | 00/44012 | | 7/2000 |
| WO | 01/31737 | | 5/2001 |
| WO | 01/73891 | A1 | 10/2001 |
| WO | 01/73893 | A1 | 10/2001 |
| WO | 03/098732 | A1 | 11/2003 |

OTHER PUBLICATIONS

Brown, W.C., "The History of Power Transmission by Radio Waves," *IEEE Transactions on Microwave Theory and Techniques*, vol. MTT-32, No. 9, pp. 1230-1242 (Sep. 1984).

Fay, P., et al., "High-Performance Antimonide-Based Heterostructure Backward Diodes for Millimeter-Wave Detection," *IEEE Electron Device Letters*, vol. 23, No. 10, pp. 585-587 (Oct. 2002).

Gold, S.H.,et al., "Review of High-Power Microwave Source Research," *Rev. Sci. Instrum.*, vol. 68, No. 11, pp. 3945-3974 (Nov. 1997).

Koert, P., et al., "Millimeter Wave Technology for Space Power Beaming," *IEEE Transactions on Microwave Theory and Techniques*, vol. 40, No. 6, pp. 1251-1258 (Jun. 1992).

Lezec, H.J., et al., "Beaming Light from a Subwavelength Aperture," *Science*, vol. 297, pp. 820-821 (Aug. 2, 2002).

McSpadden, J.O.,et al., "Design and Experiments of a High-Conversion-Efficiency 5.8-GHz Rectenna," *IEEE Transactions on Microwave Theory and Techniques*, vol. 46, No. 12, pp. 2053-2060 (Dec. 1998).

Schulman, J.N., et al., "Sb-Heterostructure Interband Backward Diodes,"*IEEE Electron Device Letters*, vol. 21, No. 7, pp. 353-355 (Jul. 2000).

Sievenpiper, D., et al., "Beam Steering Microwave Reflector Based On Electrically Tunable Impedance Surface," *Electronics Letters*, vol. 38, No. 21, pp. 1237-1238 (Oct. 1, 2002).

Sievenpiper, D.F., et al., "Two-Dimensional Beam Steering Using an Electrically Tunable Impedance Surface," *IEEE Transactions on Antennas and Propagation*, vol. 51, No. 10, pp. 2713-2722 (Oct. 2003).

Strasser, B., et al., "5.8-GHz Circularly Polarized Rectifying Antenna for Wireless Microwave Power Transmission," *IEEE Transactions on Microwave Theory and Techniques*, vol. 50, No. 8, pp. 1870-1876 (Aug. 2002).

Swartz, N., "Ready for CDMA 2000 1xEV-Do?," *Wireless Review*, 2 pages total (Oct. 29, 2001).

Yang, F.R., et al., "A Uniplanar Compact Photonic-Bandgap (UC-PBG) Structure and its Applications for Microwave Circuits," *IEEE Transactions on Microwave Theory and Techniques*, vol. 47, No. 8, pp. 1509-1514 (Aug. 1999).

U.S. Appl. No. 10/786,736, filed Feb. 24, 2004, Schaffner et al.

U.S. Appl. No. 10/792,411, filed Mar. 2, 2004, Sievenpiper.

U.S. Appl. No. 10/792,412, filed Mar. 2, 2004, Sievenpiper.

U.S. Appl. No. 10/844,104, filed May 11, 2004, Sievenpiper et al.

Balanis, C., "Aperture Antennas," *Antenna Theory, Analysis and Design*, 2nd Edition, Ch. 12, pp. 575-597 (1997).

Balanis, C., "Microstrip Antennas," *Antenna Theory, Analysis and Design*, 2nd Edition, Ch. 14, pp. 722-736 (1997).

Bialkowski, M.E., et al., "Electronically Steered Antenna System for the Australian Mobilesat," *IEE Proc.-Microw. Antennas Propag.*, vol. 143, No. 4, pp. 347-352 (Aug. 1996).

Bradley, T.W., et al., "Development of A Voltage-Variable Dielectric (VVD), Electronic Scan Antenna," *Radar 97*, Publication No. 449, pp. 383-385 (Oct. 1997).

Chen, P.W., et al., "Planar Double-Layer Leaky Wave Microstrip Antenna, " *IEEE Transactions on Antennas and Propagation*, vol. 50, pp. 832-835 (2002).

Chen, Q., et al., "FDTD diakoptic design of a slop-loop antenna excited by a coplanar waveguide," *Proceedings of the 25th European Microwave Conference 1995*, vol. 2, Conf. 25, pp. 815-819 (Sep. 4, 1995).

Cognard, J., "Alignment of Nematic Liquid Crystals and Their Mixtures," *Mol. Cryst. Liq., Cryst. Suppl. 1*, pp. 1-74 (1982).

Doane, J.W., et al., "Field Controlled Light Scattering from Nematic Microdroplets," *Appl. Phys. Lett.*, vol. 48, pp. 269-271 (Jan. 1986).

Ellis, T.J., et al., "MM-Wave Tapered Slot Antennas on Micromachined Photonic Bandgap Dielectrics," *1996 IEEE MTT-S International Microwave Symposium Digest*, vol. 2, pp. 1157-1160 (1996).

Grbic, A., et al., "Experimental Verification of Backward-Wave Radiation From A Negative Refractive Index Metamaterial," *Journal of Applied Physics*, vol. 92, No. 10, pp. 5930-5935 (Nov. 15, 2002).

Hu, C.N., et al., "Analysis and Design of Large Leaky-Mode Array Employing The Coupled-Mode Approach," *IEEE Transactions on Microwave Theory and Techniques*, vol. 49, No. 4, pp. 629-636 (Apr. 2001).

Jablonski, W., et al., "Microwave Schottky Diode With Beam-Lead Contacts," *13th Conference on Microwaves, Radar and Wireless Communications*, MIKON-2000, vol. 2, pp. 678-681 (2000).

Jensen, M.A., et al., "EM Interaction of Handset Antennas and a Human in Personal Communications," *Proceedings of the IEEE*, vol. 83, No. 1, pp. 7-17 (Jan. 1995).

Jensen, M.A., et al., "Performance Analysis of Antennas for Hand-held Transceivers Using FDTD," *IEEE Transactions on Antennas and Propagation*, vol. 42, No. 8, pp. 1106-1113 (Aug. 1994).

Lee, J.W., et al., "TM-Wave Reduction From Grooves In A Dielectric-Covered Ground Plane," *IEEE Transactions on Antennas and Propagation*, vol. 49, No. 1, pp. 104-105 (Jan. 2001).

Linardou, I., et al., "Twin Vivaldi Antenna Fed By Coplanar Waveguide," *Electronics Letters*, vol. 33, No. 22, pp. 1835-1837 (1997).

Malherbe, A., et al., "The Compenasation of Step Discontinues in TEM-Mode Transmission Lines," *IEEE Transactions on Microwave Theory and Techniques*, vol. MTT-26, No. 11, pp. 883-885 (Nov. 1978).

Maruhashi, K., et al., "Design and Performance of a *Ka*, -Band Monolithic Phase Shifter Utilizing Nonresonant FET Switches," *IEEE Transactions on Microwave Theory and Techniques*, vol. 48, No. 8, pp. 1313-1317 (Aug. 2000).

Perini, P., et al., "Angle and Space Diversity Comparisons in Different Mobile Radio Environments," *IEEE Transactions on Antennas and Propagation*, vol. 46, No. 6, pp. 764-775 (Jun. 1998).

Ramo, S., et al., *Fields and Waves in Communication Electronics*, 3rd Edition, Sections 9.8-9.11, pp. 476-487 (1994).

Rebeiz, G.M., et al., "RF MEMS Switches and Switch Circuits," *IEEE Microwave Magazine*, pp. 59-71 (Dec. 2001).

Schaffner, J., et al., "Reconfigurable Aperture Antennas Using RF MEMS Switches for Multi-Octave Tunability and Beam Steering," *IEEE Antennas and Propagation Society International Symposium, 2000 Digest*, vol. 1 of 4, pp. 321-324 (Jul. 16, 2000).

Semouchkina, E., et al., "Numerical Modeling and Experimental Study of A Novel Leaky Wave Antenna," *Antennas and Propagation Society*, IEEE International Symposium, vol. 4, pp. 234-237 (2001).

Sievenpiper, D., et al., "Eliminating Surface Currents With Metallodielectric Photonic Crystals," *1998 MTT-S International Microwave Symposium Digest*, vol. 2, pp. 663-666 (Jun. 7, 1998).
Sievenpiper, D., et al., "High-Impedance Electromagnetic Surfaces with a Forbidden Frequency Band," *IEEE Transactions on Microwave Theory and Techniques*, vol. 47, No. 11, pp. 2059-2074 (Nov. 1999).
Sievenpiper, D., et al., "High-Impedance Electromagnetic Surfaces," *Ph.D. Dissertation*, Dept. Of Electrical Engineering, University of California, Los Angeles, CA, pp. i-xi, 1-150 (1999).
Sievenpiper, D., et al., "Low-Profile, Four Sector Diversity Antenna On High-Impedance Ground Plane," *Electronics Letters*, vol. 36, No. 16, pp. 1343-1345 (Aug. 3, 2000).
Sor, J., et al., " A Reconfigurable Leay-Wave/Patch Microstrip Aperture For Phased-Array Applications," *IEEE Transactions on Microwave Theory and Techniques*, vol. 50, No. 8, pp. 1877-1884 (Aug. 2002).
Vaughn, Mark J., et al., "InP-Based 28 $Gh_z$ Integrated Antennas for Point-to-Multipoint Distribution," *Proceedings of the IEEE/Cornell Conference on Advanced Concepts in High Speed Semiconductor Devices and Circuits*, pp. 75-84 (1995).
Vaughan, R., "Spaced Directive Antennas for Mobile Communications by the Fourier Transform Method," *IEEE Transactions on Antennas and Propagation*, vol. 48, No. 7, pp. 1025-1032 (Jul. 2000).
Wang, C.J., et al., "Two-Dimensional Scanning Leaky Wave Antenna by Utilizing the Phased Array," *IEEE Microwave and Wireless Components Letters*, vol. 12, No. 8, pp. 311-313, (Aug. 2002).
Wu, S.T., et al., "High Birefringence and Wide Nematic Range Bis-Tolane Liquid Crystals," *Appl. Phys. Lett.*, vol. 74, No. 5, pp. 344-346 (Jan. 18, 1999).
Yang, Hung-Yu David, et al., "Theory of Line-Source Radiation From A Metal- Strip Grating Dielectric-Slab Structure," *IEEE Transactions on Antennas and Propagation*, vol. 48, No. 4, pp. 556-564 (2000).
Yashchyshyn, Y., et al., The Leaky-Wave Antenna With Ferroelectric Substrate, *14th International Conference on Microwaves, Radar and Wireless Communications*, MIKON-2002, vol. 2, pp. 218-221 (2002).

* cited by examiner

COMPACT TUNABLE ANTENNA

CROSS REFERENCE TO RELATED APPLICATIONS

This application claims the benefit of U.S. Provisional Patent Application No. 60/470,025 filed May 12, 2003, the disclosure of which is hereby incorporated herein by reference.

The present document is related to the co-pending and commonly assigned patent application documents entitled "RF MEMS Switch With Integrated Impedance Matching Structure" U.S. Patent Application No. 60/470,026 filed on May 12, 2003, and "RF MEMS-Tuned Slot Antenna and a Method of Making Same", U.S. Patent Application No. 60/343,888 filed Dec. 27, 2001 and its related non-provisional application U.S. patent application Ser. No. 10/192,986, which claims priority to U.S. Ser. No. 60/343,888. The contents of these related applications are hereby incorporated by reference herein.

1. Technical Field

The technical field of this disclosure relates to tunable antennas and more specifically, a compact tunable F antenna.

BACKGROUND

Antennas that rely on the opening and closing of switches that are co-located with the antenna for tuning are well known in the prior art. An example of a MEMS tuned slot antenna used for frequency tuning is described in a co-pending U.S. Patent Application (See document number 1 below). The MEMS tuned slot antenna disclosed therein contains a slot that is shorted at one end and open at the other end, with a MEMS switch serving as the short across the open end, to determine the effective length of the slot. By closing different switches along the length of the slot, the frequency of the antenna can be tuned. At resonance, the slot measures one-half wavelength long from the closed end to the first closed MEMS switch. This antenna represents an improvement over previous tunable antenna designs because the current was forced through the switch due to the open end of the slot, thus eliminating any unwanted current paths through the ground plane. However, the effective size of this antenna is dependent on the wavelength, which can create problems when a compact antenna is needed. In general, to make any effective MEMS-tuned antenna, the MEMS switch should provide the only path for one part of the antenna current, because the finite inductance of the switch can be shorted by other nearby metal structures, particularly continuous ground planes.

Other types of MEMS tuned antennas include patch designs, such as those described in document numbers 7 and 8 (identified below), as well as dipole, and various others. These designs are not preferred because patches, dipoles, and many other antennas are tuned by adding small metal regions that extend the length of the primary metal region. When tuning is performed with MEMS switches, this often causes interference from the DC bias lines. Therefore, it is necessary that the tuning be accomplished by shorting a metal object to a large ground plane, which can serve as both a RF and DC ground. In this way, the DC bias lines can be printed along this ground plane in such a way that they have very high or very low RF impedance, so that they cause minimal interference or coupling to the radiation. The slot antenna discussed above is an ideal candidate, but it suffers from a large size. It also requires that the ground plane be extended on all edges except one, which is left open for tuning.

Thus, the two important properties for a MEMS-tuned antenna are that the MEMS switch should be the only path for the particular portion of the antenna current that provides the tuning, and the switch should be able to be attached to a large ground plane to avoid interference or coupling from the DC bias. Another important property for many portable electronics or other compact devices is that the antenna should be small compared to the operating wavelength. One antenna that embodies these features is known as an F antenna. It typically consists of a metal wire or strip lying adjacent to the edge of a ground plane, with two connecting posts, one post acting as a feed for the metal strip, and the other acting as a short for impedance matching purposes. Reference 9 below discloses an F antenna by using a loop section for tuning instead of tuning the antenna itself. This design is not nearly as elegant or flexible, as the antenna does not provide a wide and arbitrary tuning range.

The disclosed antenna addresses the aforementioned needs by providing a simple, compact tunable antenna that is suitable for handheld or portable applications. The antenna can be tuned over a broad frequency range, and the size of the antenna is not solely dependent on the operating wavelength of the antenna such as is the case with typical prior art antennas.

2. Description of Related Art

1. D. Sievenpiper, "RF MEMS-Tuned Slot Antenna and a Method of Making Same", U.S. Patent Application Ser. No. 60/343,888 and U.S. patent application Ser. No. 10/192,986, which is related to 60/343,888. These applications describe a tunable slot antenna. The presently disclosed technology is different in that the presently disclosed technology allows an antenna to be much smaller than the operating wavelength which can be important for certain handheld and/or portable applications.
2. I. Korisch, "Planar Dual Frequency Band Antenna", U.S. Pat. No. 5,926,139 describes a basic planar RF antenna and includes meander line type structures for setting the resonant frequency.
3. S. Moren, C. Rowell, "Trap Microstrip PIFA", U.S. Pat. No. 6,380,895. This patent describes another type of planar RF antenna, and also includes meander line structures for setting the resonant frequency.
4. N. Johansson, "Antenna Device and Method for Portable Radio Equipment", U.S. Pat. No. 6,016,125. This patent describes an antenna that is tunable or reconfigurable by adjusting the position of a whip portion, which contacts an impedance matching inductor. This could be used either to adjust the position of the antenna to improve the impedance match, or presumably to tune the resonant frequency of the antenna. However, this antenna requires physical control of the antenna position by a user, and the antenna is largely stationary.
5. Y. J. Chen, H. J. Li, R. B. Wu, "Multi-Resonance Horizontal U-Shaped Antenna", U.S. Pat. No. 5,644,319. This patent describes a multi-resonant antenna, however the antenna is not tunable. Furthermore, the antenna requires a folded structure that increases the size of the antenna.
6. Hiroshi Okabe, Ken Take, "Tunable Slot Antenna with Capacitively Coupled Island Conductor for Precise Impedance Adjustment", U.S. Pat. No. 6,034,655. This patent describes a slot antenna using a cavity structure.

The cavity structure increases the size of the antenna significantly, and the use of a closed-end slot forbids the use of MEMS switches.

7. Robert Snyder, James Lilly, Andrew Humen, "Tunable Microstrip Patch Antenna and Control System Therefore", U.S. Pat. No. 5,943,016 describes a method of using a patch antenna by using RF switches to connect or disconnect a series of tuning stubs. However, this antenna is extremely sensitive to the position of the bias circuits and does not have the ability to tune the polarization and the pattern.
8. Jeffrey Herd, Marat Davidovitz, Hans Steyskal, "Reconfigurable Microstrip Array Geometry which Utilizes Microelectromechanical System MEMS switches", U.S. Pat. No. 6,198,438 describes an array of patch antennas that are connected by RF MEMS switches. This antenna can be selectively tuned by turning on or off various switches to connect the patches together. Larger or smaller clusters of patches will create antennas operating at lower or higher frequencies. However, this antenna requires a large number of switches and the antenna does not provide a way to eliminate the problem of interference between the DC feed lines and the RF part of the antenna.
9. Gerard Hayes, Robert Sadler, "Convertible Loop/Inverted F Antennas and Wireless Communicators Incorporating the Same", U.S. Pat. No. 6,204,819 describes an F-type antenna. However, this antenna has significant drawbacks due to its complexity. The antenna requires each separate frequency of operation to be addressed by a different type of antenna (loop, F, etch). This requires a different set of design equations for different resonant frequencies and modes of operation. Furthermore, this antenna does not allow for angle diversity.
10. De Los Santos "Tunable Microwave Network Using Microelectromechanical. Switches" U.S. Pat. No. 5,808,527 describes a MEMS switch for tuning, but does not discuss integration of a switch into an antenna.
11. Lam, Tangonan, and Abrams, "Smart Antenna System Using Microelectromechanically Tunable Dipole Antennas and Photonic Bandgap Materials" U.S. Pat. No. 5,541,614 describes an antenna system using microelectromechanically tunable dipole antennas and photonic bandgap materials.

SUMMARY

The presently disclosed technology provides an F type antenna that addresses the aforementioned needs. The antenna is much more compact than previous designs and has the ability to match the input impedance to a 50 ohm transmission line over a broad tuning bandwidth. This is primarily due to the simple resonant structure that provides the mode or modes of radiation. The tuning mechanism of the present invention is also compatible with MEMS switch devices. Previous switches were somewhat lossy, which results in a low-efficiency antenna. This effect is aggravated by high-Q antennas, and thus rules out tunable F-type antennas, which are typically high Q. The compact nature of the F-type antenna could allow it to be used in, for example, a handheld transceiver or for in-car communications with a PDA or telephone. Also, the ability to tune the resonant frequency would allow a single antenna to be installed in cars that are sold in different countries, since the antenna could simply be tuned to use the frequencies allocated for each service in each individual country. Other services that could benefit from such an antenna are AMPS, PCS, Bluetooth, 802.1 1a, or military bands.

An embodiment of a tunable F antenna for transmitting/receiving a RF signal at a desired one of a plurality of different frequencies is disclosed. The antenna comprises an electrically conductive tab positioned along a conductive sheet. A plurality of switches is provided which act when closed to couple the conductive sheet to the electrically conductive tab. The plurality of switches are closable in a controlled manner to change a desired resonant frequency at which the antenna transmits/receives the RF signal. A feed line coupled to the electrically conductive tab is provided for coupling the RF signal to/from the electrically conductive tab.

Other embodiments of a tunable F antenna for transmitting/receiving a RF signal at a desired one of a plurality of different frequencies are disclosed. The antenna comprises an electrically conductive tab positioned along a conductive sheet. A plurality of switches is provided which act when closed to couple the conductive sheet to the electrically conductive tab. The plurality of switches are closable in a controlled manner to change a desired resonant frequency at which the antenna transmits/receives the RF signal. The plurality of switches is also positioned so as to allow adjustment of the radiation pattern of RF signal. A feed line coupled to the electrically conductive tab is provided for coupling the RF signal to/from the electrically conductive tab.

BRIEF DESCRIPTIONS OF THE FIGURES

FIG. 1*a* shows the front side of an antenna according to one embodiment of the present invention.

Figure 1B:
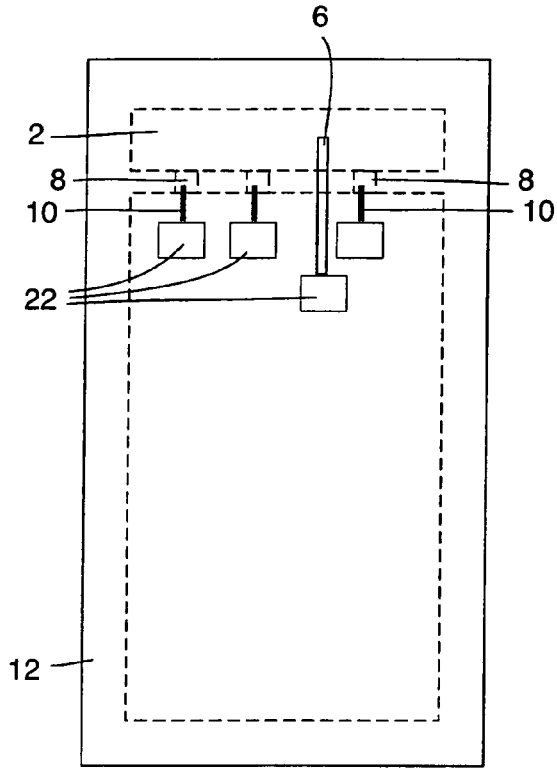

FIG. 1*b* shows the backside of the antenna depicted in FIG. 1*a*.

Figure 1C:
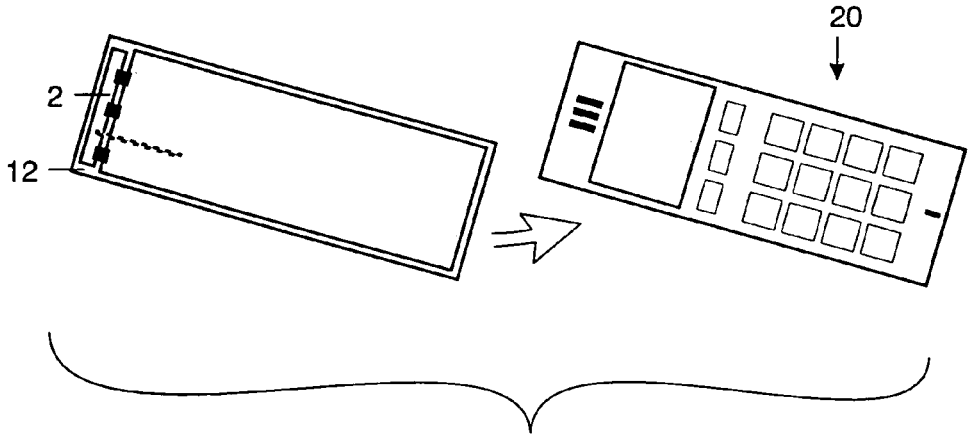

FIG. 1*c* shows an embodiment of the antenna of FIG. 1*a* sized to be received inside a handheld device.

Figure 2A:
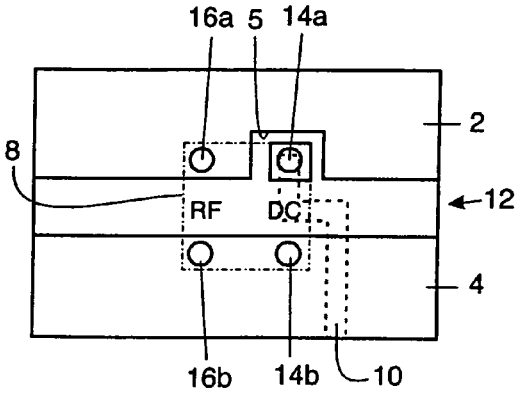

FIG. 2*a* shows a transparent view of a switch which may be used in the present invention.

Figure 2B:
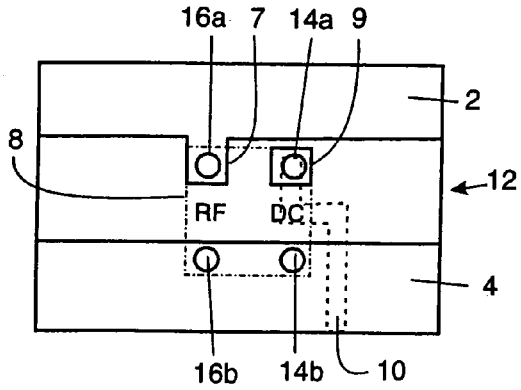

FIG. 2*b* shows a transparent view of a switch which may be used in the present invention.

Figure 3A:
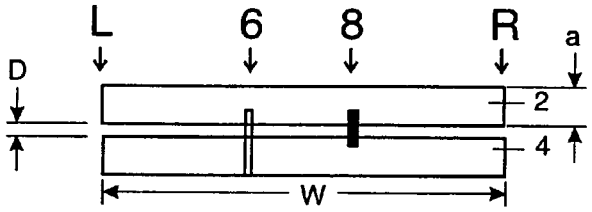

FIG. 3*a* shows a simplified diagram of the antenna depicted in FIG. 1*a*.

Figure 3C:
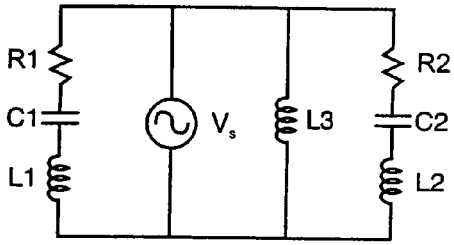
Figure 3B:
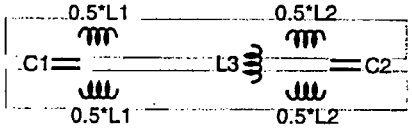

FIG. 3*b* shows the relationships between the components of the equivalent circuit of FIG. 3*c* and the model of FIG. 3*a*.

FIG. 3*c* shows the equivalent circuit for the antenna depicted in FIG. 3*a*.

FIGS. 4*a*-1 through 4*f*-2 show the simulated and measured resonant frequencies for the antenna depicted in FIG. 3*a* for different switch positions.

Figure 5A:
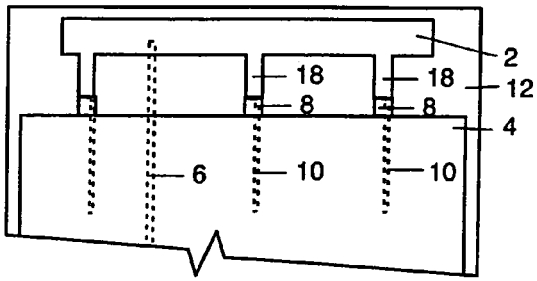
Figure 5B:
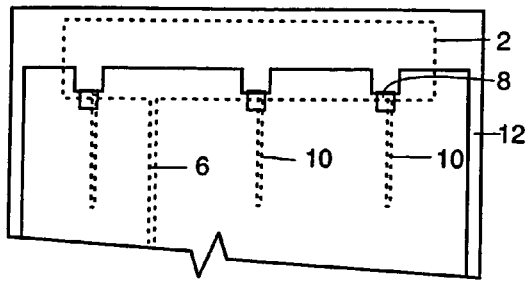

FIGS. 5*a* and 5*b* show an alternate embodiment for placing the electrically conductive tab relative to the conductive sheet/ground plane.

Figure 5C:
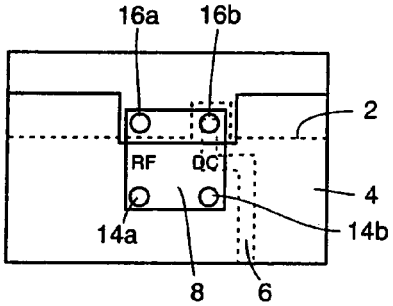

FIG. 5*c* shows how the switch is coupled to the electrically conductive tab and the conductive sheet/ground plane when using the embodiment depicted in FIG. 5*b*.

Figure 5D:
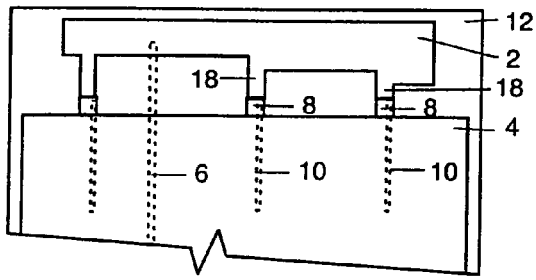

FIG. 5*d* shows an embodiment of providing an electrically conductive tab having different thicknesses between switches.

Figure 6:
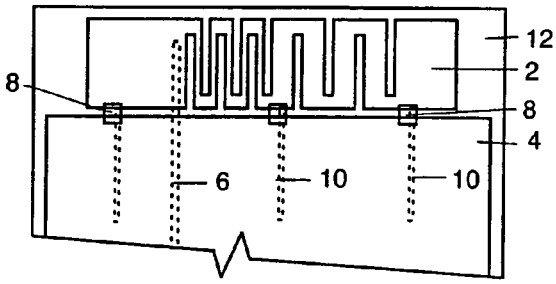

FIG. 6 shows an alternate embodiment for the electrically conductive tab.

Figure 7A:
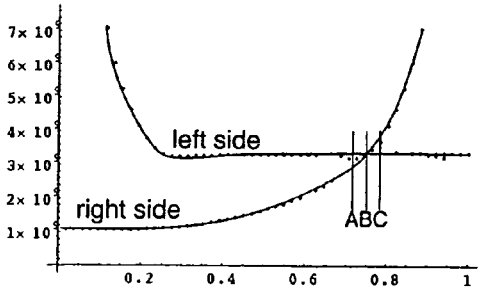

FIG. 7*a* shows a graph of the resonant frequencies of the antenna for each side of the antenna for different switch positions.

Figure 7B:
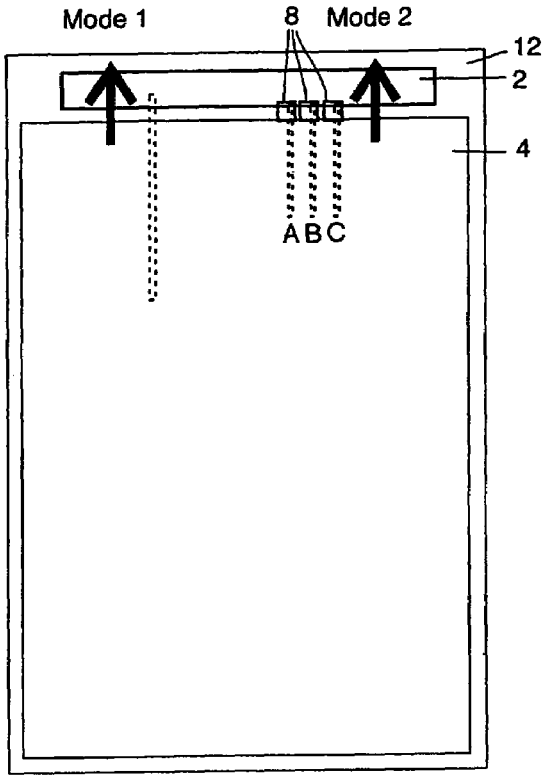

FIG. 7*b* shows where the antenna depicted in FIG. 1*a* emits the two modes.

Figure 7C:
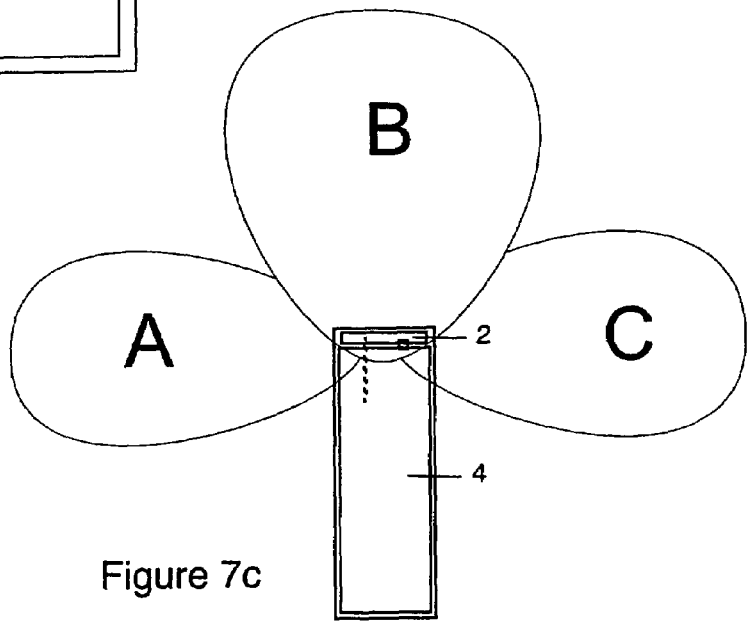

FIG. 7*c* shows how the radiation pattern can be changed depending on which switches are closed.

DETAILED DESCRIPTION OF PREFERRED EMBODIMENTS

This technology will now be described more fully hereinafter with reference to the accompanying drawings, in which preferred embodiments are shown. The presently described technology may be embodied in many different forms and should not be construed as limited to the embodiments set forth herein. Further, the dimensions of certain elements shown in the accompanying drawings may be exaggerated to more clearly show details. The present disclosure should not be construed as being limited to the dimensional relations shown in the drawings, nor should the individual elements shown in the drawings be construed to be limited to the dimensions shown.

FIG. 1*a* depicts a front side view of an F antenna according to the present disclosure. The antenna, in its most basic form, comprises an electrically conductive tab 2, a conductive sheet or ground plane 4, a feed line 6, and switches 8. F antennas can be broadly characterized as typically having an antenna size between ¼–½ the wavelength of the operating frequency of the antenna. Due to the small size of F antennas, the components may be conveniently mounted on dielectric substrate 12 preferably provided by a circuit board such as those used in small electronic devices, such as a portable handset device, cellular telephone, PDA, or other communication device 20, as shown by FIG. 1*c*. However, those skilled in the art will realize that the antenna according to the presently disclosed technology can be integrated into a variety of devices and is not limited to portable handset devices. The components of the antenna will now be described in more detail.

Since the antenna of FIG. 1*a* can be used in portable handheld devices, it is to be appreciated that the antenna of FIG. 1*a* may be sized for use in such applications. FIG. 1*c* shows an embodiment of the antenna of FIG. 1*a* sized for use in a handheld device 20.

The antenna comprises an electrically conductive tab 2, preferably formed by etching a metal, such as copper, conventionally used on commercially available circuit boards 12. The conductive sheet 4 can also be conveniently etched from the same metal. The electrically conductive tab 2 can be used to transmit or receive a RF signal. If the electrically conductive tab 2 is used to transmit a RF signal, it will receive the RF signal to be transmitted from the feed line 6 (preferably implements by a microstrip line) mounted on the backside of the printed circuit board 12. The feed line 6 is shown as a dashed line in FIG. 1*a*, to indicate its position relative to the electrically conductive tab 2, conductive sheet 4, and switches 8. In order to transmit a RF signal, one of the switches 8 (discussed later) should electrically short the electrically conductive tab 2 and the conductive sheet 4. Also, the positioning of the switch 8 should provide a resonance which is substantially the same as the RF signal to be transmitted. This will be discussed in further detail later.

Similarly, if the antenna is used to receive a RF signal, the position of the switches 8 should provide a resonance with corresponds to the RF signal to be received. When a RF signal is received, the electrically conductive tab 2 couples the received RF signal into the feed line 6, where it can be coupled into other components for further processing. Shown in FIG. 1*a* are three switches 8, however, the actual number of switches used is a design consideration as will be discussed later. Furthermore, it will become apparent that by providing multiple switches at different locations along the conductive metal tab 2, the antenna may be tuned to transmit or receive multiple RF signals.

FIG. 1*b*is a rear view of the antenna of FIG. 1*a*, depicting the feed line 6 and switch actuating lines 10 on the backside of the circuit board 12, together with other circuits 22 that may be used with the antenna. The switch actuating lines 10 are used to activate the switches 8, as is discussed later. The electrically conductive tab 2, conductive sheet 4, and switches 8 are shown in dashed lines to indicate their position on the front side of circuit board 12 relative to the feed line 6 and switch actuating lines 10. The feed line 6 is connected to the electrically conductive tab 2 through a metal via (not shown) in the circuit board 12. The feed line 6 can be coupled to the electrically conductive tab 2 at a fixed location anywhere along the longitudinal axis of the electrically conductive tab 2. Although the electrically conductive tab 2 does not have preferred dimensions, the frequency and passband of the antenna are dependent on its physical dimensions, such as its width and length.

Located adjacent to the electrically conductive tab 2 is a conductive sheet 4, as illustrated in FIG. 1*a*. The conductive sheet 4 and electrically conductive tab 2 are connected with switches 8. To help reduce the size of the antenna, the switches 8 are preferably in the gap between the electrically conductive tab 2 and conductive sheet 4 to eliminate the need for wire bonds or similar structures to link the switches 8 to the electrically conductive tab 2 and conductive sheet 4. This distance D between the electrically conductive tab 2 and conductive sheet 4 is typically about 1 mm. There is a slight dependence of the bandwidth of the antenna on the distance D; increasing D will increase the bandwidth, but this effect is usually so small as to be immeasurable. Theoretically, D could be increased to provide significantly large bandwidths, however this would put severe constraints on being able to reduce the size of the antenna.

When one of the switches 8 is activated a short between the electrically conductive tab 2 and the conductive sheet 4 is created. An example of a switch 8 that may be used in this application is described in U.S. Patent Application No. 60/470,026 filed May 12, 2003 mentioned above The switch 8 may be placed on either side of the feed line 6. The number of switches 8 used is a matter of design and will be discussed later. Because high currents typically pass through the closed switch 8, the antenna will have high efficiency if the switch 8 has low RF loss. As such, the switch 8 is preferably a RF MEMS switch fabricated on a GaAs substrate using micromachining techniques.

A close-up views of an exemplary switch 8 are shown in FIGS. 2*a* and 2*b*. The portions shown in these views roughly corresponds to the region bounded by dashed line 3 in FIG. 1*a*. Only the switch ports and terminals are shown and not the internal switch construction of switch 8 for ease of illustration. The switch 8 preferably has a rectangular layout and includes first and second DC bias ports 14*a*, 14*b*, and first and second RF terminals 16*a*, 16*b*. The first DC bias port 14*a* is connected through the circuit board 12 in the gap between the electrically conductive tab 2 and conductive sheet 4 its associated control line 6 on the backside of the printed circuit board 12. The second DC bias port 14*b* is connected to the conductive sheet 4. The first RF terminal 16*a* is mounted on (and connected to) the electrically conductive tab 2 and the second RF terminal 16*b* is mounted on the conductive sheet 4. To accommodate this arrangement, the electrically conductive tab 2 may be fabricated with a recess 5 to accommodate the first DC bias port 14*a* as shown in FIG. 2*a*, or a protrusion 7 to connect to the first RF terminal 16*a* as shown in FIG. 2*b*. The switch 8 is preferably a MEMS type switch of the type that is operated by moving a cantilever beam (not shown), which beam bends downwards to couple the first and second RF terminals 16*a*, 16*b* together when the switch actuating lines 10 provides an actuating voltage between the DC bias ports 14*a*, 14*b*. The second DC bias port 14*b* can serve as both a DC and RF ground by connecting the second DC bias port 14*b* to the second RF terminal 16*b* with, for example, wire bonds. In some embodiments, the switch 8 may have as few as three terminals/ports (a ground, a DC bias port and a RF terminal). Like the feed line 6, the actuating lines 10 are preferably disposed on the backside of the circuit board 12 (See FIG. 1*b*) and are preferably connected to the switches 8 using metal vias 9 through the circuit board 12

If desired, the switches 8 may be disposed on the backside of the circuit board 12, in which case the switch actuation lines 10 may connect directly to the first DC bias port 14*a*. In that case, metal vias will be preferably used to connect the first and second RF terminals 16*a*, 16*b* to the electrically conductive tab 2 and conductive sheet 4, respectively, and connect the second DC bias port 14*b* to the conductive sheet 4. In either case, the switch 8 is preferably sealed in a package and may be electrically connected to the circuit board 12 using a variety of well-known techniques such as flip chip bonding, wave soldering, or wire bonding.

Shown in FIG. 3*a* is a simplified diagram of the antenna depicted in FIGS. 1*a* and 1*b*. This simplification is for modeling purposes only, but the concepts described below are applicable to the larger conductive sheet 4 depicted in FIGS. 1*a* and 1*b*. The complete equivalent circuit for the simplified antenna is depicted in FIG. 3*c* and the relationships between the equivalent circuit of FIG. 3*c* and the model of FIG. 3*a* is depicted by FIG. 3*b*. In the simplified diagram of FIG. 3*a*, the antenna is assumed to comprise a symmetric pair of metal strips, functioning as an electrically conductive tab 2 and a conductive sheet 4. In the antenna shown in FIG. 3*a*, the total width (W) of the electrically conductive tab 2 and conductive sheet 4 is normalized to one. The width (W) of the electrically conductive tab 2 effectively determines the size of the antenna. A feed line 6 is coupled to the electrically conductive tab 2 and a closed switch 8 is used to create a connection between the feed line 6 and conductive sheet 4. Typically, for a given antenna, the feed line 6 is located at a fixed position, so the antenna parameters will depend on the position of the closed switch 8 relative to the position of the feed line 6. One important difference between this antenna and the previously discussed slot antennas is the fact that the size of this antenna can be made much smaller than the operating wavelength. This has significant advantages for portable devices and other applications where compact antennas are required. For example, when the electrically conductive tab 2 has a width between 5–6 cm, the antenna has been shown to resonate at 900 MHz, 1.9 GHz, and 2.45 GHz. An antenna size (width of the conductive metal tab 2) of 5–6 cm operating at 2.45 GHz may be comparable to current state of the art devices, however, current state of the art devices operating at 900 MHz require an antenna size on the order of 15 cm. In addition, by varying the capacitive and inductive properties of the antenna using the techniques described herein, higher and lower resonant frequencies can be produced using the same electrically conductive tab 2. As a result, it is clear that the size of the antenna described herein can be fixed and made independent of the RF signal being transmitted or received with a given frequency range. Thus, the size of the antenna can remain small. This is a result of the fact that the present antenna relies on embedded resonant structures that can be modeled as the lumped circuit elements shown in FIG. 3*b* and discussed below.

The portion of the electrically conductive tab 2 and conductive sheet 4 located to the left (L) of the feed line 6 can be modeled by inductor L1, and the portion of the electrically conductive tab 2 and conductive sheet 4 located to the right (R) of the switch 8 when closed can be modeled by inductor L2. The region between electrically conductive tab 2 and conductive sheet 4, to the left of the feed line 6, and to the right of the closed switch 8, can be modeled as capacitors C1 and C2, respectively. Finally, the region between the electrically conductive tab 2 and conductive sheet 4, and between the feed line 6 and closed switch 8, can be modeled as inductor L3, while the capacitance of that region is neglected. Resistors R1 and R2 act as radiation dampers. Vs is the signal the feed line 6 provides to the electrically conductive tab 2. The presence of L1, C1, and L2, C2 produce two main resonant frequencies. The values of L1, L2, L3, C1, C2, R1, and R2 can then be used to predict the behavior of the antenna, specifically the resonant frequencies of the antenna.

The values of L1, L2, L3, C1, C2, R1, and R2 can be approximated by determining the capacitance/unit length (Eq. 1) and inductance/unit length (Eq. 2).

$$\text{Capacitance/unit length} = \frac{\text{width}\ (eps1 + eps2)}{\pi * \text{ArcCosh}(a/g)} \qquad \text{Eq. 1}$$

$$\text{Inductance/unit length} = \text{Capacitance/unit length} * (\text{Characteristic Impedance})^2 \qquad \text{Eq. 2}$$

Where:

Characteristic Impedance=377 Ω width=Horizontal Width of electrically conductive tab (W)

eps0=permittivity of free space eps1=dielectric constants of the material above antenna (typically air)

eps2=dielectric constants of the material below antenna (typically the substrate on which the antenna is mounted, i.e. the circuit board)

a=length of the electrically conductive tab or conductive sheet/ground plane (the (the tab an sheet are both assumed to be symmetric)

D=size of the gap

L1=Min[feed line, switch]*Inductance/unit length

L2=(1−Max[feed line, switch])*Inductance/unit length

L3=Absolute Value of (feed line−switch)*Inductance/unit length

C1=Min[feed line, switch]*Capacitance/unit length

C2=(1−Max[feed line, switch])*Capacitance/unit length

Min[feed line, switch] is the distance between the feed line 6 or the switch 8, whichever is smaller with respect to the left most side of the electrically conductive tab 2, as shown in FIG. 3*a*.

Max[feed line, switch] is the distance between the feed line 6 or the switch 8, whichever is greater with respect to the left most side of the electrically conductive tab, as shown in FIG. 3*a*.

Since the resonant frequencies of the antenna are determined by the Capacitance/unit length and the Inductance/unit length, one can design an antenna for any frequencies of interest by varying these parameters. Furthermore, the total impedance (z) of the antenna can be calculated using Equation 3.

$$z = \frac{1}{1/z1 + 1/z2 + 1/z3} \quad \text{Eq. 3}$$

where $$z1 = j\omega L1 + \frac{1}{j\omega C1} + R;$$

$$z2 = j\omega L2 + \frac{1}{j\omega C2} + R; \text{ and}$$

$$z3 = j\omega L3.$$

R, which is the same as R1 and R2 shown in FIG. 3*c*, is the radiation resistance, which is somewhat arbitrary. The behavior of the antenna is determined primarily by the frequencies of two main resonances, and R mainly determines the bandwidth of these different resonances. It typically has a value of more than a few ohms, but much less than 377 ohms. The value of ω is the angular frequency of the signal provided by the feed line 6.

Finally, using the values of z, the magnitude of the reflection for various switch positions can be determined by using equation 4. Equation 4 is the formula for the reflection in a 50-ohm transmission line that is terminated by impedance, z.

$$\text{Reflection}=20*\log\,[\text{Abs}[(50-z)/(50+z)]] \quad \text{Eq. 4}$$

Shown in FIGS. 4*a*-1 through 4*f*-2 are simulated graphs of the expected resonant frequencies as well as the measured resonant frequencies for various switch positions using the antenna depicted in FIG. 3*a*. Initially, the feed line 6 is fixed at a distance ¼L away from the left edge with the following parameters.

Characteristic Impedance=377Ω
width (W)=7.5 cm
eps0=$8.85\times10^{-12}$
eps1=eps0
eps2=4×eps0
a=1 cm
D=1 mm
R=20 Ω

In the graphs depicted in FIGS. 4*a*-1 through 4*f*-2, the x-axis represents the frequencies, and the y-axis represents the reflection (return loss). As will be seen, the return loss is significantly lower at the resonant frequencies. Also, as the position of the switch 8 moves from the left side of the antenna towards the right side. We can observe changes in the frequencies of the two main modes, which are associated with the capacitors C1, C2, combined with inductors L1, L2, L3, which radiate energy into free space as modeled by radiation resistors R1 and R2. When the switch 8 is near the left edge, the resonant frequency associated with C1 and L1 is high, while the resonant frequency associated with C2 and L2 is low. This is because of the relatively larger capacitance and inductance associated with C2 and L2 when the switch 8 is near the left edge.

Figures 1, 4A:
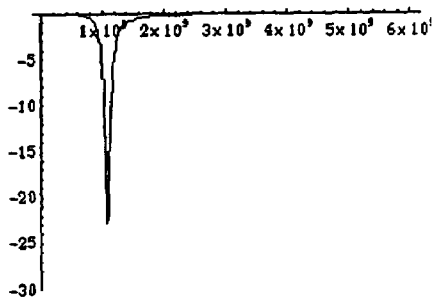
Figures 2, 4A:
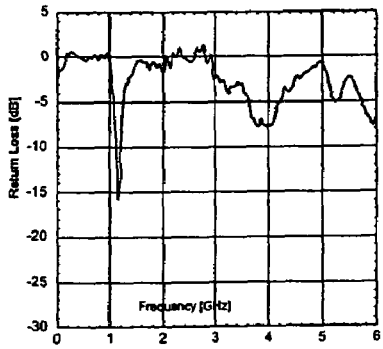
Figures 1, 4B:
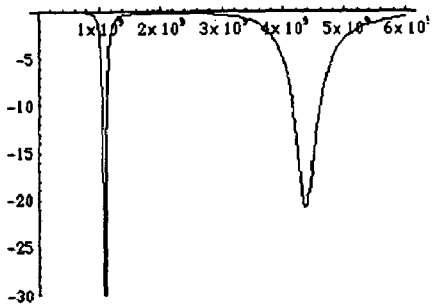
Figures 2, 4B:
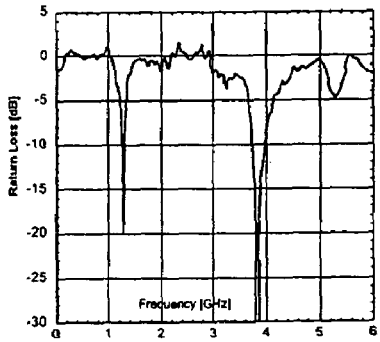

FIG. 4*a*-1 is the simulated results and FIG. 4*a*-2 depicts the measured results for an embodiment where the switch 8 is located at a distance 1/16W away from the left edge and a single resonant frequency associated with C2 and L2 is seen near 1 GHz. The resonant frequency associated with C1 and L1 is too high and cannot be seen in FIGS. 4*a*-1 and 4*a*-2. As the switch 8 is moved toward the feed line 6, the resonance associated with C1 and L1 shifts lower because the change in placement of the switch 8 causes the values of C1 and L1 to increase. FIG. 4*b*-1 is the simulated results and FIG. 4*b*-2 depicts the measured results for an embodiment where switch 8 is located at a distance 3/16W away from the left edge of the antenna. The resonance previously seen around 1 GHz has moved up in frequency slightly, and a second resonant frequency associated with C1 and L1 is seen near 4 GHz.

Figures 1, 4C:
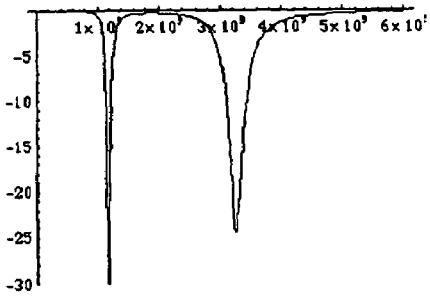
Figures 2, 4C:
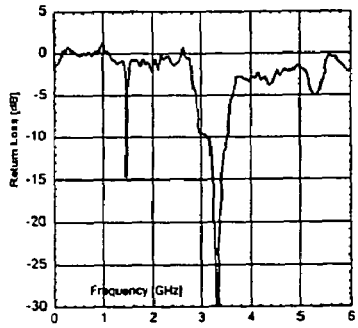
Figures 1, 4D:
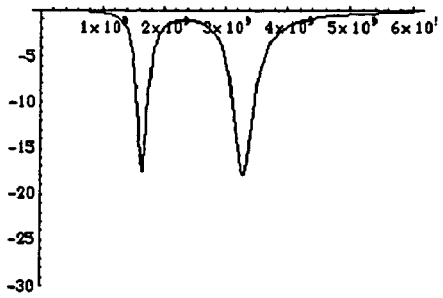
Figures 2, 4D:
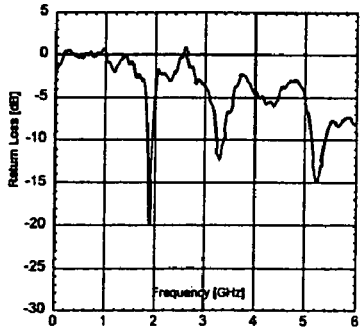
Figures 1, 4E:
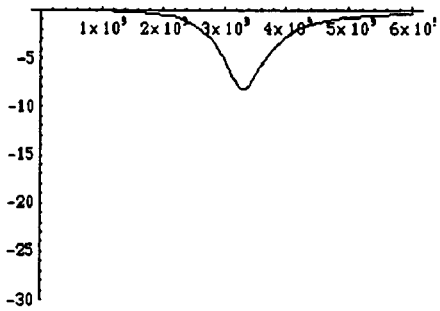
Figures 2, 4E:
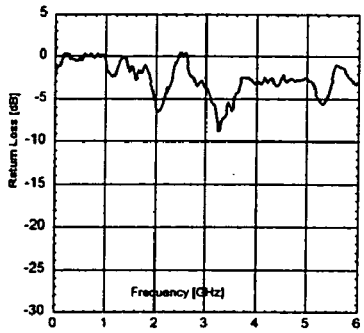
Figures 1, 4F:
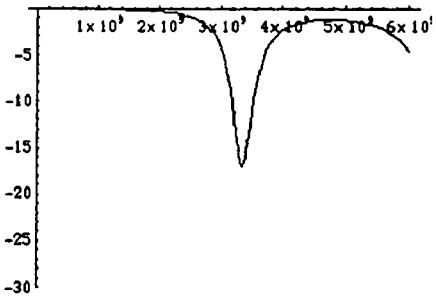
Figures 2, 4F:
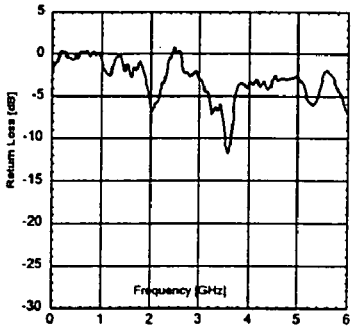

FIG. 4*c*-1 is the simulated results and FIG. 4*c*-2 depicts the measured results for an embodiment where the switch 8 is located a distance 5/16W away from the left side. As can be seen, the two resonant frequencies broaden and move closer to each other, because the switch has moved past the feed line 6. As the switch 8 moves past the feed line 6 the two resonant frequencies continue moving towards each other (See FIG. 4*d*-1 which depicts the simulated results and FIG. 4*d*-2 which depicts the measured) until the switch 8 is symmetric to the feed line 6 (i.e. located a distance ¾W away from the left edge). At this point the two resonant frequencies merge into a single resonance as shown in FIGS. 4*e*-1 (depicting the simulated results) and 4*e*-2 (depicting measured results). Then, as the switch 8 moves closer to the right edge, the two resonant frequencies cross, as shown in FIGS. 4*f*-1 (depicting the simulated results) and 4*f*-2 (depicting measured results), where the switch 8 is located a distance 13/16W away from the left edge. Now the resonance associated with C2 and L2 is higher in frequency because the values for C2 and L2 decrease as the switch 8 moves closer to the right side of the antenna 1. As shown in FIGS. 4*f*-1 and 4*f*-2, the resonance associated with C2 and L2 is approximately 6 GHz, while the resonance associated with C1 and L1 is around 3.5 GHz. In this way it can be seen that a plurality of switches 8 may be provided at various positions along the conductive metal tab 2 to provide a plurality of resonances.

Since the values for C1, C2, L1, and L2 partially determine the resonances associated with the antenna, one can design an antenna of this type for any resonances by varying the values for Capacitance/unit length and Inductance/unit length. One way of lowering the Capacitance/unit length to increase the bandwidth of the resonant frequencies, is to place the electrically conductive tab 2 further away from the conductive sheet 4 as shown in FIG. 5*a*. In this case, fingers 18 are extended from the electrically conductive tab 2 to the switches 8. Of course, it would also be possible to extend fingers from the conductive sheet 4 up to the switches 8. If the fingers 18 are made sufficiently narrow they will not significantly add to the capacitance. In addition, the distance between the electrically conductive tab 2 and conductive sheet 4 can be different in the regions between the switches 8 as shown in FIG. 5*d*.

In order to increase the Capacitance/unit length so as to lower the resonant frequencies for a given width of the electrically conductive tab 2, the electrically conductive tab 2 and conductive sheet 4 can be made to overlap on opposite sides of the circuit board as shown in FIG. 5*b*. A recessed area is made in either the electrically conductive tab 2 or conductive sheet 4 (shown in the conductive sheet 4 in FIG. 5*b*) to prevent the electrically conductive tab 2 and conductive sheet 4 from being shorted together. The first and second DC ports 14*a*, 14*b*, and the first and second RF terminals 16*a*, 16*b* can be appropriately connected to the electrically conductive tab 2 and conductive sheet 4 either directly, or through metal vias as shown in FIG. 5*c*.

Also, the Inductance/unit length can be increased to lower the resonant frequencies without significantly reducing their bandwidth for a given antenna size, or to increase the magnetic component of the stored field to improve efficiency. Increasing the Inductance/unit length can be accomplished by meandering the electrically conductive tab 2 as shown in FIG. 6 between neighboring switches 8. Those skilled in the art will realize that both the inductance and capacitance modification structures discussed above can have different geometries in different regions to achieve greater control of the frequency and bandwidth of each resonance.

If appreciable size is allowed for the width of the electrically conductive tab 2, such as somewhere between one-quarter and one-half the wavelength of the operating frequency, then the antenna can also be made to have an adjustable radiation pattern. As previously discussed, different resonant modes are associated with different regions in the antenna (e.g. C1, L1, and C2, L2). If these modes are close together, and the antenna is excited at a fixed frequency, then the relative frequencies of the modes can be considered as a phase difference between these various regions in the antenna. An illustrative example of this is further discussed below. If the right side of the antenna (C2 and L2) leads the left side (C1 and L1) in phase, then the sum of these modes will result in a beam that is directed to the left. If the right side lags the left, then the beam will be directed toward the right. If they are exactly in phase, then the beam will be directed to the broadside. In each case, the radiation pattern can be further modified by controlling the dielectric constant on either side of the antenna, since the radiation will tend to be stronger on the side with the higher dielectric constant.

FIG. 7*a* shows a plot of the resonance frequencies of the two main modes (x-axis) of the antenna as a function of position of the switch 8 (y-axis) for the antenna depicted in FIG. 3*a*. The resonance frequencies are labeled as Left Side and Right Side. The resonance designated Left Side is the resonance associated with the left side of the antenna, (i.e. L1, C1). The resonance designated Right Side is the resonance associated with the right side of the antenna, (i.e. L2, C2). Also shown in FIG. 7*a* are three vertical lines, designated A, B, and C. These lines correspond to switches A, B, C shown in FIG. 7*b*. FIG. 7*a* shows the resonant frequencies of the two main modes for the left side and right side when either switch A, B, or C is closed. Switch B is nearly symmetrical with the feed line 6, and at that point, the two modes cross in frequency. Switches A and C can be placed at several locations near this point, typically within 2–5 mm and used to adjust the radiation pattern. However, those skilled in the art will realize that the actual placement of switches A and C will also depend on the geometry of the antenna and the bandwidth. Depending on which switch 8 is closed, the relative phases of the two main modes, labeled as Mode #1 and Mode #2 in FIG. 7*b*, can be adjusted, thus changing the radiation pattern. If switch B is closed, then the radiation will be strongest towards the broadside. If switch A or C is closed, then the radiation will be stronger either to the left, or right side, respectively. This concept is illustrated in FIG. 7*c* as three separate beams, and shows how this technique can be used for angle diversity in a multipath environment.

From the foregoing description, it will be apparent that the presently described technology has a number of advantages, some of which have been described herein, and others of which are inherent in the disclosed embodiments. Also, it will be understood that modifications can be made to the apparatus and method described herein without departing from the teachings of subject matter described herein. For example, the edges of the conductive tab 2 and the conductive sheet 4 in the disclosed embodiment are depicted as being defined by straight lines. However, when installed the disclosed antenna in a handheld device such as a cellular telephone or a personal digital assistant (and in any other communications device), it may prove convenient in such applications to round the corners (or other portions) of the tab 2 and/or the sheet 4, in order to more easily accommodate the disclosed antenna in a communications device. As such, the tab 2 and sheet 4 do not necessarily need to be limited to the rectilinear embodiments depicted by the figures. For such reasons and others, the disclosed technology is not to be limited to the described embodiments except as required by the appended claims.

What is claimed is:

1. A tunable antenna for transmitting and/or receiving a RF signal at a desired one of a plurality of different frequencies, the antenna comprising:

a conductive sheet;

an electrically conductive tab having a width dimension and a length dimension, the electrically conductive tab being positioned adjacent to, but spaced from, the conductive sheet;

a plurality of switches placed along the width dimension of the electrically conductive tab, each switch of said plurality of switches controllable to electrically connect the conductive sheet to the electrically conductive tab;

a feed line for coupling an RF signal to and/or from the electrically conductive tab; and the plurality of switches being controllable to change a desired resonant frequency at which the antenna transmits and/or receives the RF signal.

2. The antenna of claim 1, wherein the plurality of switches is placed at selected points along the electrically conductive tab, the selected placements determining the resonant frequency of the antenna.

3. The antenna of claim 1, further comprising an actuating line associated with each switch, the actuating line controlling opening and closing of an associated switch.

4. The antenna of claim 1, wherein the plurality of switches is placed along the electrically conductive tab so as to allow the radiation pattern of the transmitted RF signal to be adjusted.

5. The antenna of claim 1, wherein the conductive tab has a recessed region for accommodating a connector associated with a switch of the plurality of switches.

6. The antenna of claim 1, wherein the conductive tab comprises a protrusion for accommodating a switch of the plurality of switches.

7. The antenna of claim 1, wherein at least one switch of the plurality of switches comprises a MEMS switch.

8. The antenna of claim 1, wherein the plurality of different frequencies span a frequency range, and wherein the width dimension of the conductive tab is smaller than the wavelength associated with the smallest frequency in the frequency range.

9. The antenna of claim 8, wherein the width dimension of the conductive tab is independent of the wavelength associated with the frequency in the frequency range at which the RF signal is being transmitted or received.

10. The antenna of claim 9, wherein the frequency range is between 900 MHz and 2.45 GHz.

11. The antenna of claim 10, wherein the width dimension of the antenna is between 5 and 6 cm.

12. The antenna of claim 1, wherein the conductive sheet, the electrically conductive tab, the plurality of switches and the feed line are all mounted on a common dielectric substrate.

13. The antenna of claim 1 wherein the tab and the conductive sheet each has a rectilinear configuration.

14. A method for transmitting and/or receiving a RF signal at a desired one of a plurality of different frequencies comprising:

providing an electrically conductive sheet;

providing an electrically conductive tab having a width dimension and a length dimension, the electrically conductive tab positioned adjacent to the conductive sheet;

providing a plurality of switches along a width of the conductive tab, each switch of said plurality of switches controllable to electrically connect the conductive sheet to the electrically conductive tab;

coupling an RF signal to and/or from the electrically conductive tab; and closing the plurality of switches in a controlled manner to change a desired resonant frequency at which the antenna transmits and/or receives the RF signal.

15. The method of claim 14, further comprising varying the position of the plurality of switches, thereby varying the radiation pattern of the transmitted RF signal.

16. The method of claim 14, further comprising varying the geometry of the conductive tab, thereby varying the resonant frequency of the antenna.

17. The method of claim 14, further comprising providing a conductive tab having a recessed region for accommodating a switch in the plurality of switches.

18. The method of claim 14, further comprising providing a conductive tab having a protrusion for accommodating a switch in the plurality of switches.

19. The method of claim 14, further comprising providing an actuating line associated with each switch, the actuating line controlling the switch.

20. The method of claim 14, wherein at least one switch of the plurality of switches comprises a MEMS switch.

21. The method of claim 14, wherein the plurality of different frequencies span a frequency range, and wherein the width dimension of the conductive tab is smaller than the wavelength associated with the smallest frequency in the frequency range.

22. The method of claim 21, wherein the width dimension of the conductive tab is independent of the wavelength associated with the RF signal being transmitted or received within the frequency range.

23. The method of claim 22, wherein the frequency range is between 900 MHz and 2.45 GHz.

24. The method of claim 23, wherein the width dimension of the antenna is between 5–6 cm.

25. The method of claim 14 wherein at least one of the electrically conductive sheet and the electrically conductive tab has a perimeter having a rectilinear configuration.

26. The method of claim 14, wherein the wherein the conductive sheet, the electrically conductive tab, the plurality of switches and the feed line are all mounted on a common dielectric printed circuit board substrate, the conductive sheet and the tab being etched printed circuit board metallic members.

27. An antenna for transmitting and/or receiving a RF signal at a desired one of a plurality of different frequencies, the antenna comprising:

a conductive sheet;

an electrically conductive tab having a first dimension, the electrically conductive tab positioned adjacent to the conductive sheet;

a plurality of switches placed along the first dimension of the electrically conductive tab, each switch of said plurality of switches controllable to electrically connect the conductive sheet to the electrically conductive tab;

a feed line for coupling an RF signal to and/or from the electrically conductive tab; and the plurality of switches being controllable to change a desired resonant frequency at which the antenna transmits and/or receives the RF signal, and wherein the plurality of switches are placed at selected points so as to allow the radiation pattern of RF signal to be adjusted.

28. The antenna of claim 27, further comprising an actuating line associated with each switch, the actuating line controlling the switch.

29. The antenna of claim 27, wherein the conductive tab comprises a recessed region for accommodating a switch in the plurality of switches.

30. The antenna of claim 27, wherein the conductive tab comprises a protrusion for accommodating a switch in the plurality of switches.

31. The antenna of claim 27, wherein at least one switch of the plurality of switches comprises a MEMS switch.

32. The antenna of claim 27, wherein the plurality of different frequencies span a frequency range, and wherein the first dimension of the conductive tab is smaller than the wavelength associated with the smallest frequency in the frequency range.

33. The antenna of claim 32, wherein the first dimension of the conductive tab is independent of the wavelength associated with the frequency in the frequency range at which the RF signal is being transmitted or received.

34. The antenna of claim 33, wherein the frequency range is between 900 MHz and 2.45 GHz.

35. The antenna of claim 34, wherein the first dimension of the antenna is between 5–6 cm.

36. The antenna of claim 27, wherein the antenna is an F-antenna irrespective of which switch or switches of said plurality of switches is closed.

37. The antenna of claim 1, wherein the conductive sheet and the electrically conductive tab each have a major surface portion disposed on a common surface of a dielectric substrate.

38. The antenna of claim 1, wherein an entirety of said conductive sheet and an entirety of said electrically conductive tab are each disposed in a coplanar relationship to each other.

39. The antenna of claim 27, wherein the conductive sheet and the electrically conductive tab each have a major surface portion disposed on a common surface of a dielectric substrate.

40. The antenna of claim 27, wherein at least a portion of said conductive sheet and at least a portion of said electrically conductive tab are each disposed in a parallel, coplanar relationship to each other.

41. The antenna of claim 1, wherein said feed line comprises a microstrip line disposed to bridge a gap arranged between said conductive sheet and said electrically conductive tab.

42. The antenna of claim 41, wherein said plurality of switches also bridge said gap arranged between said conductive sheet and said electrically conductive tab.

43. The antenna of claim 1, wherein said feed line couples RF energy to and/or from the electrically conductive tab independently of and remotely from said plurality of switches.

44. The antenna of claim 1, wherein said plurality of switches are grouped together near one end of said conductive tab and said feed line is disposed near another end of said conductive tab.

45. The antenna of claim 44, wherein said feed line comprises a microstrip line disposed to bridge a gap arranged between said conductive sheet and said electrically conductive tab and wherein said plurality of grouped together switches are also arranged to separately bridge said gap.

* * * * *